US007295417B2

(12) United States Patent
Kotwicki

(10) Patent No.: US 7,295,417 B2
(45) Date of Patent: Nov. 13, 2007

(54) ELECTROMAGNETIC VALVE ACTUATION WITH SERIES CONNECTED ELECTROMAGNET COILS

(75) Inventor: Allan J. Kotwicki, Williamsburg, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 561 days.

(21) Appl. No.: 10/838,903

(22) Filed: May 4, 2004

(65) Prior Publication Data

US 2005/0248902 A1 Nov. 10, 2005

(51) Int. Cl.
*H01H 47/00* (2006.01)

(52) U.S. Cl. ..... 361/156

(58) Field of Classification Search ..... 361/154, 361/155, 156

See application file for complete search history.

(56) References Cited

U.S. PATENT DOCUMENTS

| | | | | |
|---|---|---|---|---|
| 2,654,023 | A * | 9/1953 | Rost | 246/130 |
| 2,958,025 | A * | 10/1960 | De Villiers et al. | 318/135 |
| 3,896,346 | A | 7/1975 | Ule | |
| 5,717,562 | A | 2/1998 | Antone et al. | |
| 5,815,365 | A | 9/1998 | Stege | |
| 5,883,776 | A | 3/1999 | Keegan et al. | |
| 5,952,738 | A | 9/1999 | Miller | |
| 6,005,763 | A | 12/1999 | North | |
| 6,050,281 | A | 4/2000 | Adams et al. | |
| 6,123,058 | A | 9/2000 | Endou | |
| 6,140,717 | A | 10/2000 | Fischer et al. | |
| 6,324,046 | B1 | 11/2001 | Kadah | |
| 6,363,895 | B1 | 4/2002 | Butzmann et al. | |
| 6,948,461 | B1 * | 9/2005 | Kotwicki | 123/90.11 |

FOREIGN PATENT DOCUMENTS

| | | |
|---|---|---|
| JP | 10-131726 | 5/1998 |
| JP | 11-294123 | 10/1999 |
| JP | 11-294124 | 10/1999 |
| JP | 2000-110593 | 4/2000 |
| JP | 2003-007532 | 1/2003 |

OTHER PUBLICATIONS

Gunselmann, CH. and Melbert, J.—"Improved Robustness and Energy Consumption for Sensorless Electromagnetic Valve Train", SAE Technical Bulletin 2003-01-0030, reprinted from Variable Valve Actuation 2003 (SP-1752/SP-1752CD), Mar. 2003, 10 pages.

* cited by examiner

*Primary Examiner*—Ronald W. Leja
(74) *Attorney, Agent, or Firm*—Allan J. Lippa; Bir Law, PLC; David S. Bir

(57) ABSTRACT

Systems and methods for valve actuation use series-connected coils of upper and lower electromagnets acting as electromagnetic generators that attempt to maintain a constant magnetic flux, while their forces are essentially independent. A valve controller initiates valve actuation by reducing holding force of the holding electromagnet. As spring force begins to move an armature away from the holding electromagnet, the associated coil generates a voltage that attempts to maintain constant flux. This generated voltage causes a large increase in current that essentially transfers the flux to the other on-coming coil, which attracts and holds the armature against its associated spring force to open or close the valve. The internal voltage generated inside the two coils operates even if the coils are supplied with zero external voltage (shorted) to transfer stored energy directly between the coils. Energy may be transferred indirectly using an energy storage device.

23 Claims, 4 Drawing Sheets

ELECTROMAGNETIC VALVE ACTUATION WITH SERIES CONNECTED ELECTROMAGNET COILS

BACKGROUND OF THE INVENTION

1. Field of the Invention

The present invention relates to a system and method for actuation of a valve, such as an intake and/or exhaust valve of an internal combustion engine.

2. Background Art

Electromagnetic or electronic valve actuation (EVA) offers greater control authority and can significantly improve engine performance and fuel economy under various operating conditions relative to conventional camshaft arrangements. EVA systems use electromagnetic actuators to electrically or electronically open and close the intake and/or exhaust valves.

Electromagnetic actuators controlled by an associated valve controller, engine controller, and/or vehicle controller may use electromagnets or solenoids to attract an armature that operates on the valve stem. In a typical electromagnetic actuator, two opposing electromagnets and associated springs are used to open and close an engine valve in response to the signals generated by the controller. The upper and lower electromagnets are energized to assist the springs in closing and opening the valve, respectively, and to hold the valve closed or open against the associated spring force. The upper spring exerts a downward force that pushes the valve downward as the upper electromagnet is turned off, while the lower spring exerts an upward force that pushes the valve upward as the lower electromagnet is turned off. The opening, closing, and landing speeds of the valve are functions of a number of parameters including the spring forces and the excitation currents of the electromagnets.

Prior art EVA control strategies have incorporated one or more capacitors in the control circuitry for energy recovery. For example, Japanese patent application 10-282974 (Pub. No. 2000-110593) published Apr. 18, 2000 discloses the use of capacitors to store energy released during shut off of a coil to power the same coil and/or an alternate or following coil during a subsequent energization. Similarly, U.S. Pat. No. 3,896,346 discloses a parallel or shunting capacitor to store energy recovered from one coil during de-energization to subsequently energize another coil. Japanese patent application 2001-183078 (Pub. No. 2003-007532) published Jan. 10, 2003 discloses the use of a capacitor to recover energy stored in one coil and transfer the energy to a low voltage power supply for subsequent use.

Some prior art EVA control strategies have employed dual "H" bridges to separately control the two electromagnets to control valve movement. This approach typically requires power electronics for each actuator coil. In addition, conventional "H" bridge circuitry regenerates energy and current flows backward through various "H" bridge components to the power supply when reverse voltage is applied to the holding coil during launch, which may result in wasted energy. In addition, such an arrangement requires additional "H" bridge components to allow applied coil voltage to be reversed.

Japanese patent application 2001-183078 (Pub. No. 2003-007532) published Jan. 10, 2003 (described above) discloses actuators having permanent magnets used in combination with electromagnets to provide an attractive force to move/hold the valve. The upper and lower electromagnet coils are arranged in series with corresponding "H" bridge drive electronics to generate a current flow that lowers the force of the permanent magnet to launch the armature, while using the same current to generate an attractive force in the second electromagnet to catch the armature (in combination with the attractive force of a second permanent magnet). The current is then reversed to provide a repelling, braking force to land the valve. The reverse current is also used to generate a force relative to the second permanent magnet to again launch the armature, while generating an attractive force by the first electromagnet to catch the armature (in combination with the first permanent magnet force).

SUMMARY OF THE INVENTION

The present invention provides for simplified valve actuation using a modified "H" bridge arrangement by recognizing that the upper and lower electromagnet coil forces are essentially independent. As such the upper and lower electromagnet coils are arranged in series to provide respective attractive forces such that current switching or reversal through the coils is not necessary. Start-up control may be provided by appropriate selection of coil strengths, one or more permanent magnets, or using a switching device to reduce or eliminate the force generated by one of the electromagnets, for example.

Embodiments of the present invention include a system and method for actuating a valve having an armature coupled to a valve stem and movable between first and second electromagnets having series connected coils during an opening or closing event to open and close the valve, such as an intake or exhaust valve of an internal combustion engine. The opening or closing events include a launch from a first (holding) electromagnet, travel or flight of the armature across a gap between the first and second electromagnets, a catch by the second (catching) electromagnet, and a hold by the second electromagnet. The current supplied to the electromagnets is reduced so that the force of the holding electromagnet (and permanent magnet if present) is less than the opposing force of its associated spring to launch the armature. The system and method use conservation of magnetic flux to transfer energy stored in the first electromagnet to the second electromagnet, directly in one embodiment, or via an energy storage device controlled through a switching element in another embodiment. In one embodiment, the system and method may reverse the polarity of the voltage applied to the series connected coils to more quickly transfer the energy to the catching coil to achieve a desired system response time and reduce losses.

The system and method may include a starting device for initialization in preparation for subsequent opening or closing events. In one embodiment, the starting device is implemented by a switching device connected between the two electromagnet coils to selectively isolate one of the coils during system initialization or start-up. Other implementations of a starting device may include the use of a permanent magnet to bias an associated valve toward an open or closed position, or biasing electromagnet strength of either the upper or lower electromagnets based on the number of windings of the coil or core material, for example, to provide a predictable initial state of the valve. Depending upon the particular application and implementation, different valves may be biased toward different positions.

In various embodiments the system and method may selectively couple a capacitive and/or inductive energy storage device to the electromagnet coils via one or more controllable switches, which may be implemented by transistors and/or SCRs, for example. In these embodiments, the system and method control the switches to couple the energy storage device to the coils during launching to capture energy stored in the electromagnets as the armature begins to move during launch. The capacitor may then be decoupled from the coils during armature flight between the electromagnets and recoupled to the electromagnets during the landing phase to generate an appropriate attractive force for the catch phase of the opening or closing event.

The present invention provides a number of advantages. For example, the present invention reduces the power electronics required by arranging the coils in series so that both coils are driven by common power electronics. Relative to a conventional "H" bridge arrangement for each coil, the present invention reduces the drive electronics by half. A series coil arrangement according to the present invention also reduces the number of power wires required by one-fourth (¼), which, for a four valve-per-cylinder eight cylinder engine, results in a reduction of 128 wires. The present invention may be used to transfer energy stored in the magnetic field of one coil directly to the other coil in the same actuator, or stored energy may be transferred from the coils to an energy storage device, such as a capacitor, during launch, and subsequently transferred from the energy storage device back to the coils during the capture and landing phases of a valve opening or closing event. This results in efficient energy use that may contribute to reduced emissions and/or improved fuel economy for automotive applications.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

Figure 1:
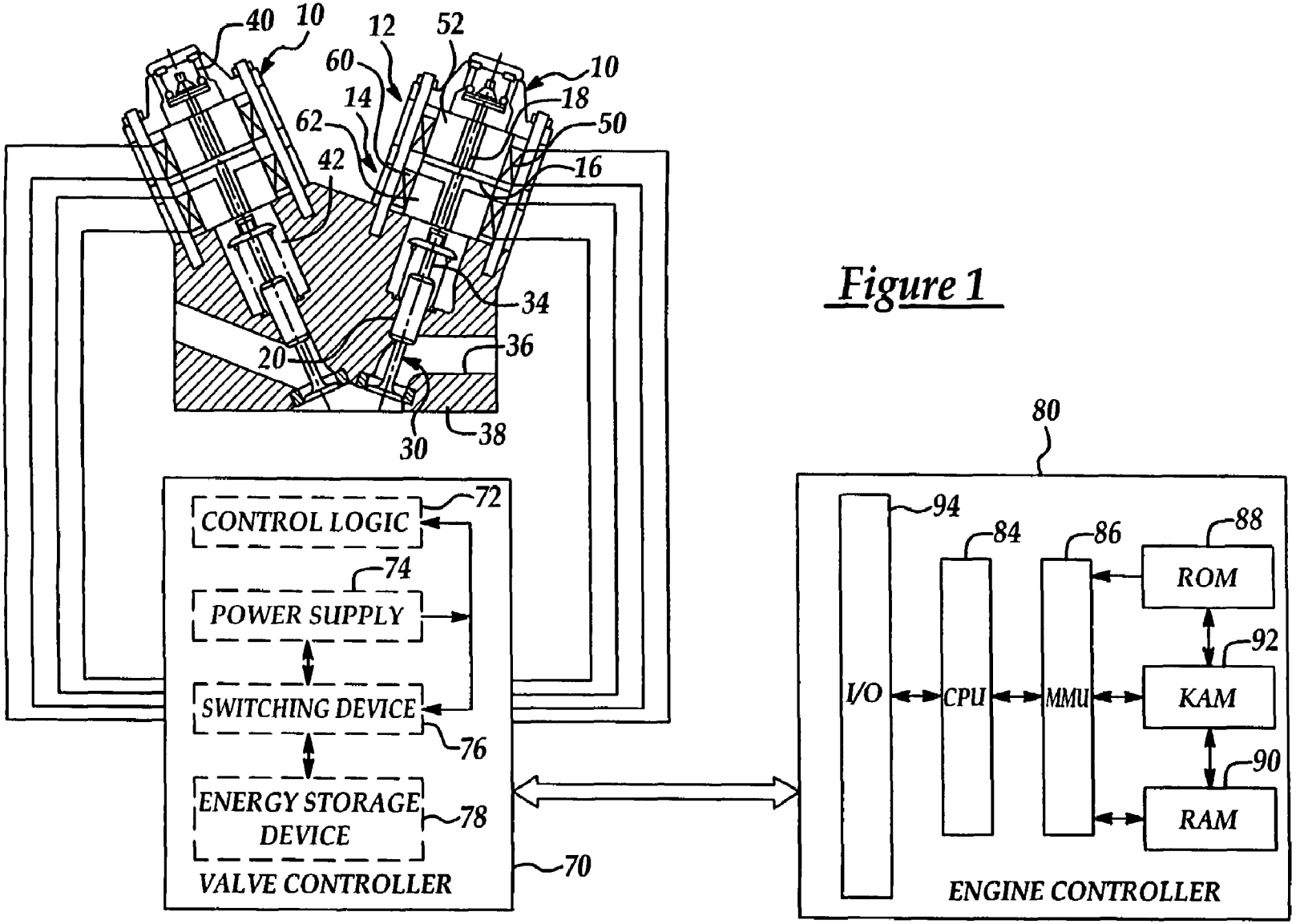
FIG. 1 is a diagram illustrating a representative application for a system or method for valve actuation with start-up control according to the present invention.

Referring now to the drawings wherein like reference numerals are used to identify similar components in the various views, FIG. 1 is a cross-section illustrating one embodiment of a valve actuator assembly for an intake or exhaust valve of an internal combustion engine according to the present invention. Valve actuator assemblies 10 include an upper electromagnet 12 and a lower electromagnet 14. As used throughout this description, the terms "upper" and "lower" refer to positions relative to the combustion chamber or cylinder with "lower" designating components closer to the cylinder and "upper" referring to components axially farther from the corresponding cylinder. Those of ordinary skill in the art will recognize that actuator assemblies 10 generally include similar components that function in a similar or identical manner but may be sized differently to operate intake or exhaust valves, for example. The present invention is independent of the particular type of valve actuation and may be applied or adapted to a variety of applications.

As illustrated in FIG. 1, an armature 16 extends between the coils of electromagnets 12, 14 radially outward from an armature shaft 18, which extends axially through a bore in upper electromagnet 12 and lower electromagnet 14, guided by one or more bushings in the electromagnet assemblies, similar to valve bushing 20. Armature shaft 18 is operatively associated with an engine valve 30 that includes a valve head and valve stem. As those of ordinary skill in the art will appreciate, various connecting or coupling arrangements other than illustrated in FIG. 1 may be used to translate axial motion of armature 16 between upper and lower electromagnets 12, 14 to valve 30 to open and close valve 30 and selectively couple intake passage 36 within an engine cylinder head 38 to a corresponding combustion chamber or cylinder.

Actuator assemblies 10 also include an upper spring 40 operatively associated with armature shaft 18 for biasing armature 16 toward a neutral position away from upper electromagnet 12, and a lower spring 42 operatively associated with valve stem 34 for biasing armature 16 toward a neutral position away from lower electromagnet 14.

Upper electromagnet 12 includes an associated upper coil 50 wound through a corresponding slot in upper core 52 encompassing armature shaft 18. Lower electromagnet 14 includes an associated lower coil 60 wound through a corresponding slot in lower core 62 encompassing armature shaft 18. Upper coil 50 and lower coil 60 are connected in series and arranged so that current traveling through coils 50 and 60 generates an attractive force that attracts armature 16 toward both electromagnets 12, 14. However, as recognized by the present invention, the typical gap size between upper and lower electromagnets 12, 14 is sufficiently large so that the force generated by each electromagnet can be considered independent. The attractive forces generated by upper electromagnet 12 and lower electromagnet 14 are preferably substantially equal and symmetrical relative to the gap between the armature and the respective electromagnet as illustrated and described with reference to FIG. 4. However, either electromagnet may be designed to generate a stronger force than the other for a given current to provide for a predictable starting or initial condition. This may be accomplished by increasing the number of windings in one of the coils, modifying the core material or geometry of one of the electromagnets, by incorporating a permanent magnet, or by appropriate selection of spring constants and lengths, for example. Alternatively, or in combination, start-up control may be provided using an appropriate switching device as described in greater detail below.

A valve controller 70 may be provided to control system initialization and valve actuation, preferably by directly or indirectly controlling current supplied to upper and lower electromagnets 12, 14 according to the present invention. Depending upon the particular implementation, voltage polarity across the electromagnet coils may be reversed while maintaining direction of the current to provide desired response characteristics while transferring stored energy directly between the upper and lower electromagnets 12, 14.

The various components or functions of valve controller 70 may be implemented by a separate controller as illustrated, or may be integrated or incorporated into an engine, vehicle, or other controller, such as engine controller 80, depending upon the particular application and implementation. Valve controller 70 may include control logic 72 to control power supply 74 and one or more switching devices 76 to selectively store and recover energy from one or more energy storage devices 78 and/or to selectively provide start-up control as described in greater detail herein. Depending upon the particular implementation, valve controller 70 may also include control logic functioning as a velocity controller using power supply 74 and one or more switching devices 76 to provide a soft launch during valve opening. Alternatively, a separate velocity controller may be used to launch the valve during an opening event and remove any lash between armature shaft 18 and the valve stem of valve 30.

In one embodiment, to initialize the system before actuating the valves, valve controller 70 controls one or more switching devices 76 to isolate upper coil 60 from lower coil 50 while providing current from power supply 74 so that current passes through only one coil. The resulting force generated by the associated electromagnet attracts the armature to provide a known starting position (either open or closed depending upon the particular type of valve, i.e. intake or exhaust, the cylinder number and/or the particular application, for example). The switching device(s) may then be controlled to re-establish the series connection of the coils so that the holding current passes through both coils.

In general, to open or close a valve, controller 70 provides a launching pulse that reduces the force generated by the holding electromagnet (and any associated permanent magnet for applications using a permanent magnet to bias the valve position and provide a predictable starting position) so it is less than the opposing force provided by the associated spring. Depending upon the particular application and controller implementation, the launching pulse may be provided by reducing energy supplied to the system by controlling the power supply, or by redirecting some of the energy stored in the holding electromagnet to an energy storage device as explained in greater detail below. As the armature moves away from the holding electromagnet, stored energy may be transferred directly to the catching electromagnet, or to an energy storage device for subsequent transfer to the catching electromagnet. For applications using an energy storage device, valve controller 70 may control one or more switching devices 76 to transfer energy from series-connected coils 50,60 to energy storage device 78 using control logic 72. As the armature moves toward the catching electromagnet, control logic 72 controls switching device(s) 76 and/or power supply 74 to transfer the stored energy from energy storage device 78 to series-connected coils 50, 60 to increase the catching force generated by the catching electromagnet. At this point in the actuation event, the armature has traveled beyond the "reach" of the original holding electromagnet so that any force generated by the original holding electromagnet has little or no effect on the armature, i.e. the forces generated by the series-connected coils are independent. Controller 70 may then control power supply 74 to provide an appropriate holding current until the next actuation event.

Controller 80 has a microprocessor 84, called a central processing unit (CPU), in communication with memory management unit (MMU) 86. MMU 86 controls the movement of data among the various computer readable storage media and communicates data to and from CPU 84. The computer readable storage media preferably include volatile and nonvolatile storage in read-only memory (ROM) 88, random-access memory (RAM) 90, and keep-alive memory (KAM) 92, for example. KAM 92 may be used to store various operating variables while CPU 84 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 84 in controlling the engine or vehicle into which the engine is mounted. The computer-readable storage media may also include floppy disks, CD-ROMs, hard disks, and the like. CPU 84 communicates with various sensors and actuators directly or indirectly via an input/output (I/O) interface 94. Interface 94 may be implemented as a single integrated interface that provides various raw data or signal conditioning, processing, and/or conversion, short-circuit protection, and the like. Alternatively, one or more dedicated hardware or firmware chips may be used to condition and process particular signals before being supplied to CPU 84. Examples of items that may be actuated under control of CPU 84, through I/O interface 94, are fuel injection timing, fuel injection rate, fuel injection duration, throttle valve position, spark plug ignition timing (for spark-ignition engines), and others. Sensors communicating input through I/O interface 94 may be indicating piston position, engine rotational speed, vehicle speed, coolant temperature, intake manifold pressure, accelerator pedal position, throttle valve position, air temperature, exhaust temperature, exhaust air to fuel ratio, exhaust component concentration, and air flow, for example. Some controller architectures do not contain an MMU 86. If no MMU 86 is employed, CPU 84 manages data and connects directly to ROM 88, RAM 90, and KAM 92. Of course, the present invention could utilize more than one CPU 84 to provide engine control and controller 80 may contain multiple ROM 88, RAM 90, and KAM 92 coupled to MMU 86 or CPU 84 depending upon the particular application.

In the embodiment illustrated in FIG. 1, controller 80 may control engine intake and exhaust valves 30 indirectly via valve controller 70. For example, engine controller 80 may provide commands to control intake and/or exhaust valve timing and phasing that are communicated to valve controller 70. Control logic 72, which may be implemented in hardware, software, or a combination of hardware and software, then controls the corresponding valve actuator(s) to implement the command in accordance with the present invention as described in greater detail herein.

Figure 2:
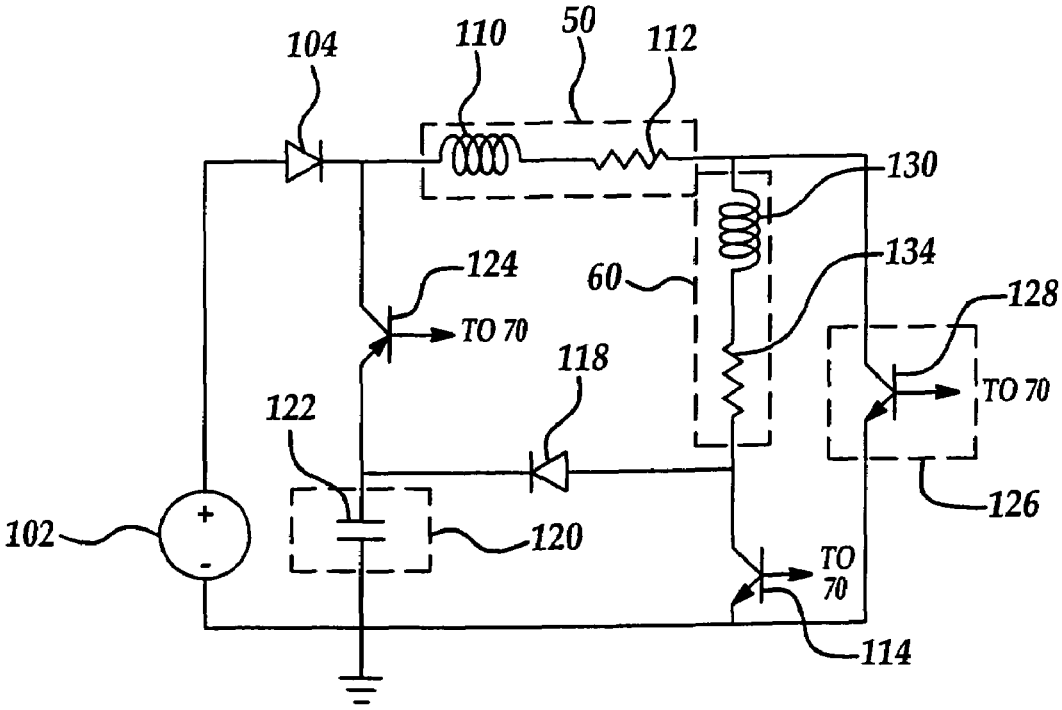
FIG. 2 is a simplified circuit schematic illustrating one embodiment of a system or method for valve actuation with start-up control according to the present invention.

A simplified circuit schematic for valve actuation according to one embodiment of the present invention is illustrated in FIG. 2. In this embodiment, the simplified circuit components are arranged in a half-bridge with an energy storage device. Those of ordinary skill in the art will appreciate that various components illustrated in the simplified circuit schematic may be replaced by one or more other components having a similar function. As such, the simplified schematic generally represents a variety of application-specific implementations consistent with the teachings of the present invention.

Power supply 102 generally represents any of a variety of power supplies that may be controlled to provide a desired output of either voltage or current. In the embodiment described, power supply 102 is a voltage regulated switching power supply. However, power supply 102 is preferably a voltage regulated pulse width modulated switching power supply. Power supply 102 may be directly or indirectly connected to a vehicle battery, valve actuator system battery, or other power source depending upon the particular application. Power supply 102 is connected to a diode 104 to limit flow of current back through power supply 102. Upper electromagnet coil 50 and lower electromagnet coil 60 are connected in series and energized by power supply 102 through supply diode 104. Upper electromagnet coil 50 is represented by an inductive load 110 and resistive load 112, while lower electromagnet coil 60 is represented by an inductive load 130 and resistive load 134. Electromagnet coils 50, 60 are selectively connected to ground through a controllable switching device 114, such as a transistor or SCR, for example, in communication with controller 70 (FIG. 1). Coils 50,60 are connected through storage diode 118 to an energy storage device 120, which is represented by capacitor 122 in this embodiment. Those of ordinary skill in the art will recognize various other types of energy storage devices, whether capacitive, inductive, magnetic, etc., that may be used alone or in combination in accordance with the present invention. Appropriate control and operation of switching devices, such as transistors 114 and 124 may be used to transfer energy from coils 50, 60 to energy storage device 120 to provide a launching pulse and initiate armature launch as previously described. The switching device(s) may then be controlled to transfer energy from energy storage device 120 back to coils 40, 50 during capture and landing as explained in greater detail below.

The simplified circuit illustrating one embodiment of the present invention shown in FIG. 2 includes a starting or initialization device 126 implemented by a transistor 128 in this example. Starting device 126 operates to initialize the system by providing a predictable starting position for the associated valve prior to a first actuation after power-up. When implemented by transistor 128, starting device 126 operates to select coil 50 by shorting coil 60 so that substantially zero current flows through coil 60 to minimize any attractive force generated by lower electromagnet 14. This results in all current flowing through upper coil 50 so that the armature is pulled toward upper electromagnet 12 to close the valve and provide a predictable starting position for future actuation. Depending upon the particular valve, cylinder, and application, a start-up or initialization device may be used to initialize or bias the valve toward either an open or closed position, i.e. bias the armature toward the lower or upper electromagnet, respectively, to provide a predictable initial condition.

As described above, although the illustrated start-up device is preferred because it can be selectively applied for start-up and then effectively removed for normal operation, various other start-up or initialization strategies may also be used alternatively or in combination with the strategy illustrated in FIG. 2 according to the present invention. For example, either upper electromagnet 12 or lower electromagnet 14 may be biased to generate a greater attractive force for a given current. This may be accomplished by one or more of the following: providing one of the upper and lower coils with a greater number of windings relative to the other; modifying the core geometry and/or material of one electromagnet; including a permanent magnet oriented to provide an additional attractive force for one of the electromagnets; modifying associated spring constants for the upper or lower springs, etc.

As those of ordinary skill in the art will appreciate, the controllable switching devices 114, 124, and 128 are connected directly or indirectly to a controller, such as valve controller 70 (FIG. 1) that generates appropriate trigger signals to allow current to flow through the device or to block substantially all current. A representative valve controller design that may be utilized is illustrated and described in detail in copending and commonly owned U.S. patent application Ser. No. 10/838,902 titled "Electromagnet Valve Actuation", now U.S. Pat. No. 6,948,461, the disclosure of which is incorporated by reference in its entirety. As described in that application, the controller preferably includes proportional position feedback energy injection control with feedback provided by a voltage-current based position/velocity estimator (observer) in combination with feedforward energy injection to compensate for expected gas force and damping work. Feedback linearization techniques may be used to control the applied coil voltage. A launching pulse may be provided by appropriate switching of an energy storage device, and/or by appropriate control of the energy supplied to the system via the power supply, for example, as illustrated and described herein.

Operation of the simplified circuit illustrated in FIG. 2 will now be described for a representative valve opening event that does not incorporate a velocity controller to remove any lash between the armature shaft 18 (FIG. 1) and the valve stem. To initialize the system to provide a predictable starting state or condition of "valve closed", transistors 114 and 124 are "off" to block substantially all current flow while transistor 128 is "on" (conducting current) to short or isolate coil 60 from coil 50. Power supply 102 is controlled to provide a voltage sufficient to induce a current through upper coil 50 to generate a force to attract and hold the armature in the valve closed position. Once in the valve closed position, power supply 102 is controlled to provide a voltage sufficient to provide holding current through supply diode 104, and upper coil 50 to hold the valve closed against the spring force. Transistor 114 may be turned "on" and transistor 128 may be turned "off" in preparation for subsequent valve actuation.

To generate a launch pulse to initiate the opening event, transistor 114 is turned "off" with an appropriate trigger signal from valve controller 70 so that energy stored in electromagnet coils 50, 60 is transferred to capacitor 122 through diode 118 pumping capacitor 122. The quantity of energy transferred to capacitor 122 may be controlled by varying the time that transistor 114 is turned "off" during the launch phase. To initiate armature movement away from upper electromagnet coil 50, sufficient energy must be transferred from electromagnet coil 50 to lower its attractive force below that of the associated opposing spring force. For typical applications, a smaller capacity energy storage device (capacitor 122 in this example) is required to generate a launch pulse than that required to transfer substantially all of the energy stored in the electromagnets for subsequent transfer during the catch/landing phase. When transistor 114 is turned "off", current is blocked by transistors 124 and 128 ("off") and by diode 104. As the magnetic force generated by upper coil 50 decays, spring force begins to move armature 16 (FIG. 1) across the gap toward lower electromagnet coil 60. According to the present invention, transistor 114 may be energized and power supply 102 controlled to begin providing power to lower coil 60 through upper coil 50 while the armature is traversing the gap since the forces of the upper and lower electromagnets are essentially independent. Preferably, power supply 102 and transistor 114 are controlled to provide sufficient energy to lower coil 60 to compensate for various system losses, which may include electrical, mechanical, and friction losses, and work to overcome gas pressure forces (for exhaust valve applications) within an associated combustion chamber or cylinder. As the armature approaches the lower electromagnet coil 60 and compresses the associated spring 42 (FIG. 1) power supply 102 continues to be controlled to provide current to lower coil 60 through upper coil 50 while transistor 124 is turned "on" (conducting) to transfer energy stored in capacitor 122 to coils 50, 60 so that lower coil 60 generates a sufficient attractive force to catch the armature and land the valve. Transistor 124 is then turned off and power supply 102 is controlled to provide a holding current to hold the armature and valve in the open position against the spring force. Typically, the holding current is smaller than the catching current as described in greater detail below.

As such, in contrast to some prior art approaches that transfer energy to a capacitor and then back through one or more power supplies to recapture energy, the present invention transfers energy between the upper and lower electromagnets within each actuator either directly, or optionally via an energy storage device, but not back through the power supply, which improves system efficiency.

The process described above to open a valve is then reversed to close the valve. Because the system has already been initialized and the valve position is known, start-up device 126 is not needed. To initiate the event, a launching pulse is generated that lowers the energy of lower electromagnet 14. The launching pulse may include controlling power supply 102 to reduce the current through coils 50, 60 and/or selectively switching transistor 114 to "off" to transfer energy to capacitor 122 through diode 118. As the force generated by lower electromagnet 14 decays below the spring force, the armature will begin to move away from lower electromagnet 60. Transistor 114 may be turned "on" during flight of the armature across the gap to prepare for the energy transfer from capacitor 122. A catching pulse is then generated to provide an appropriate attractive force for lower electromagnet 16 to attract and land the armature. The catching pulse may by provided by appropriate injection of energy by power supply 102 and or selective switching of transistor 124 to "on" when the armature is within a catch zone of upper electromagnet 50 to transfer energy from capacitor 122 to coils 50, 60.

For applications that have a gap or "lash" between the armature shaft that pushes on the valve stem to open the valve and the valve stem, a velocity controller may be used to control the power supply voltage or current to the launching coil to move the armature across the valve lash gap during the valve opening to reduce or eliminate any noise, vibration, and harshness (NVH) issues during armature launch when the armature shaft contacts the valve stem.

As illustrated in FIG. 2, this embodiment of the present invention selectively couples (and decouples) the energy storage device (a capacitor in this embodiment) to the electromagnet coils to provide a launch pulse and allow the current into the catching coil to be controlled during a valve opening or closing event. A starting device is selectively controlled to initialize the system after power-up and provide a predictable starting position. The upper and lower electromagnet coils are connected in series with current direction that always provides an attractive force to attract the armature toward the associated electromagnet. The simplified half-bridge arrangement illustrated in FIG. 2 maintains a single direction of current through upper and lower coils 50, 60 so that current reversing circuitry is not necessary. In addition, implementations of the invention similar to the embodiment of FIG. 2 reduce the number of necessary wires from the valve controller to the valve actuator with only three (3) wires required for each actuator. Similarly, by recognizing that the upper and lower coil forces are essentially independent, the coils can be connected in series and controlled with common drive electronics, reducing the necessary drive electronics in half compared to conventional "H" bridge implementations.

As those of ordinary skill in the art will appreciate, connecting the upper and lower coils in series according to the present invention may increase the circuit resistance and thereby raise the holding power to hold the armature in the open or closed position. However, the series-connected coils reduce the time constant by one-half and reduce the necessary voltage by one-half to provide a similar time response as conventional implementations. The increased circuit resistance may be ameliorated by providing larger conductors for the coil windings and/or modifying the core material or geometry of the electromagnets to provide a similar force for a lower current or fewer windings.

Figure 3:
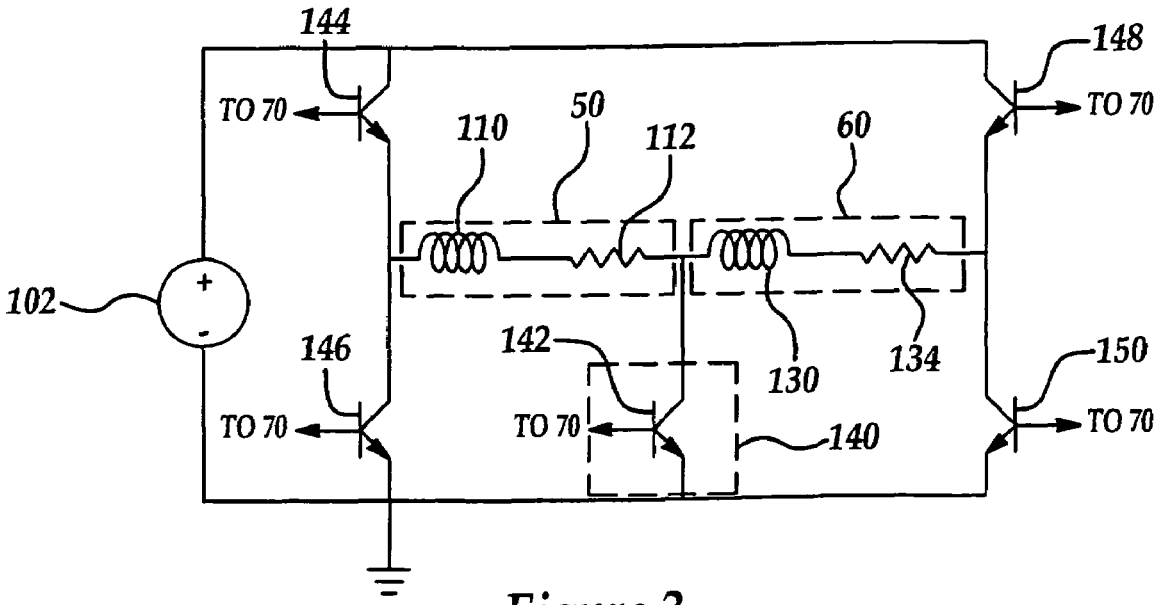
FIG. 3 is a simplified circuit schematic illustrating another embodiment of a system or method for valve actuation with start-up control according to the present invention.

FIG. 3 is a simplified circuit schematic illustrating another embodiment of a system or method for valve actuation with start-up control according to the present invention. The simplified circuit schematic of FIG. 3 utilizes an "H" bridge with upper and lower coils 50, 60 connected in series and a starting or initialization device 140 used to provide a predictable starting state or condition after system power-up. The embodiment illustrated in FIG. 3 illustrates an implementation without the use of a separate energy storage device. Rather, stored energy is transferred directly from one electromagnet to the other during valve actuation as described below. However, the embodiment of FIG. 3 could also be modified to incorporate a separate capacitive, inductive, or magnetic storage device in accordance with the present invention.

As illustrated in FIG. 3, a starting device 140 is provided to initialize the system and provide a predictable starting position (valve open or valve closed depending upon the particular valve and application) after power-up and before valve actuation. In the illustrated embodiment, starting device 140 is implemented by transistor 142, which is selectively energized to short or isolate lower coil 60 from upper coil 50. Power supply 102 is controlled to provide a voltage that induces a current through energized transistor 144. Transistors 146, 148, and 150 are "off" to block substantially all current so that current travels through upper coil 50 and through start-up transistor 142 to ground. Current flowing through upper coil 50 generates a corresponding attractive force to pull armature 16 toward upper electromagnet 12 (FIG. 1) to provide a valve-closed initial condition. Transistor 150 may be energized and transistor 142 de-energized so that current flows through lower coil 60 in preparation for valve actuation.

For a representative valve opening event beginning with the valve closed and power supply 102 controlled to provide a holding current through transistor 144, coils 50, 60, and transistor 150, power supply 102 is controlled to provide a launching pulse that reduces current through upper coil 50 to the point where spring force of the upper spring begins to move the armature away from the upper electromagnet. As the armature moves away from the upper electromagnet and past the midpoint between the upper and lower electromagnets, transistor 148 may be energized to reverse voltage polarity to improve the transient response time of the transfer of energy stored in upper coil 50 to lower coil 60 and provide a catching pulse. However, current direction remains constant through lower coil 60 so the lower electromagnet continues to generate an attractive force that pulls the armature toward the lower electromagnet to open the valve. The valve landing may be controlled by controlling power supply 102 and transistor 148 to reduce the attractive force generated by the lower electromagnet to land the armature. Power supply 102 is then controlled to induce a sufficient holding current through coils 50, 60 to hold the armature against the opposing spring force of the lower spring.

A valve closing event proceeds in a similar fashion with power supply 102 controlled to provide a launching pulse that reduces the current induced through coils 50, 60 so that the corresponding force generated by the lower electromagnet is less than the associated spring force of the lower spring. As the armature begins to move away from the lower electromagnet, conservation of magnetic flux induces an increase of internal voltage of the lower electromagnet in an attempt to maintain its flux. This results in a corresponding increase in current that effectively transfers energy stored in the lower electromagnet to the upper electromagnet. The increased current through the upper electromagnet generates a corresponding attractive force to catch and hold the armature. Power supply 102 may be controlled to provide a catching pulse and/or reduce the attractive force generated by the upper electromagnet as the armature approaches to provide a controlled landing. Power supply 102 is then controlled to induce a holding current through coils 50, 60 to hold the armature against the upper electromagnet to hold the valve closed.

According to the present invention, steady-state current flows only in one direction through coils 50, 60 during start-up and normal valve actuation with the coils 50, 60 arranged in series and oriented to generate an attractive force that attracts the armature toward the respective electromagnets. As described above, during start-up current flows from power supply 102 through transistor 144, coil 50, and transistor 142 to ground. During normal actuation (valve opening or closing), current flows through transistor 144, coils 50, 60, and transistor 150 to ground, i.e. in the same direction through coils 50, 60 whether for valve opening, valve closing, or system initialization/start-up. Likewise, in the embodiments illustrated in FIG. 2, current flows from power supply 102 through diode 104, coil 50 and transistor 128 during start-up. Similarly, holding current flows in the same direction through diode 104, coils 50, 60 and transistor 114. During valve opening or closing, current again flows in the same direction through coils 50, 60 from power supply 102 and/or to and from energy storage device 120.

Figure 4:
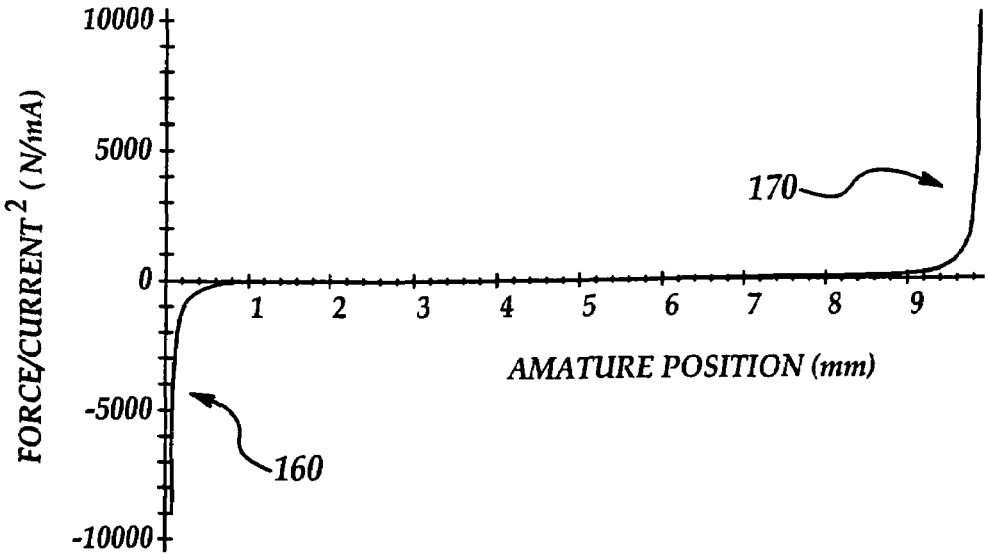
FIG. 4 is a graph illustrating independence of coil forces for series connected coils of a representative actuator according to one embodiment of the present invention.

FIG. 4 is a graph illustrating independence of coil forces for series connected coils of a representative actuator according to one embodiment of the present invention. The graph of FIG. 4 plots force/current^2 as a function of armature position. The graph assumes a distance of ten millimeters (10 mm) between electromagnets with the origin representing an armature position with the armature resting against the upper electromagnet, for example. As can be seen by the plot of FIG. 4, the force/current^2 of the upper electromagnet 160 diminishes rapidly as distance from the upper electromagnet increases and is substantially zero at a distance of 1 millimeter (mm). Similarly, the lower electromagnet force/current^2 does not increase until the armature is within about 1 millimeter (mm) of the lower electromagnet at a distance of about 9 millimeters (mm) from the upper electromagnet. Stated differently, for a given current traveling through the series connected coils of the upper and lower electromagnets, the force of the upper electromagnet has negligible or no effect on the armature once the armature moves more than 1 mm away from the upper electromagnet and vice versa for the lower electromagnet. As such, even when connected in series, the coil forces are essentially independent so that the coils can be controlled using a common set of control/drive components.

As illustrated and described with reference to FIGS. 2-5, the present invention recognizes that the series-connected coils of the upper and lower electromagnets act as electromagnetic generators that attempt to maintain a constant magnetic flux, while their forces are essentially independent. During valve actuation, as the spring force begins to move the armature away from the holding electromagnet, the associated coil generates a voltage that attempts to maintain constant flux. This generated voltage causes a large increase in current that essentially transfers the flux to the other on-coming coil, which attracts and holds the armature against its associated spring force to become the holding coil. As such the present invention uses the internal voltage generated inside the two coils, which operates even if the coils are supplied with zero external voltage (shorted), to transfer stored energy directly between the coils. The invention may also be used to indirectly transfer the energy between the two coils via an energy storage device as illustrated and described with reference to FIG. 2. In contrast to conventional strategies that transfer energy back through one or more power supplies (either directly or through an energy storage device), transfer of energy between coils of the upper and lower electromagnets according to the present invention may result in reduced losses and more efficient operation.

Figure 5:
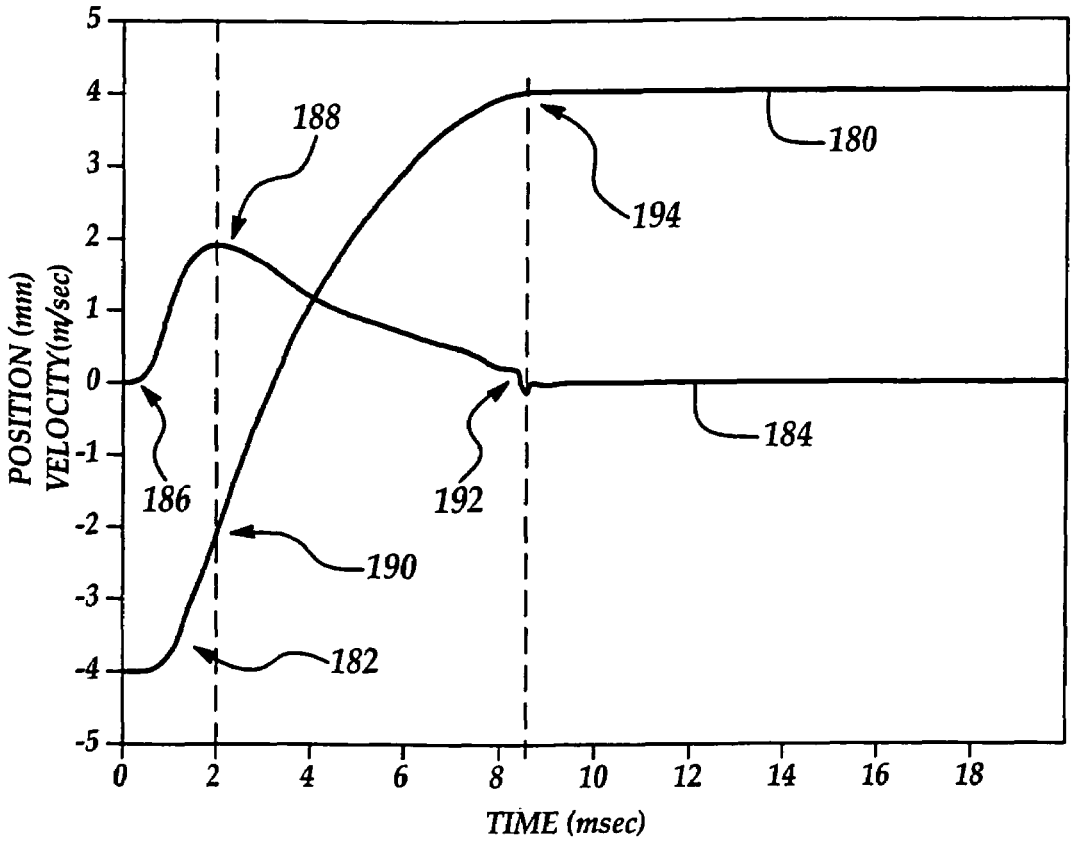
FIG. 5 is a graph of armature position and velocity as a function of time generated by simulation for a representative exhaust valve opening with series connected coils according to the present invention.

FIG. 5 is a graph generated by simulation of an unoptimized 200V exhaust valve actuator with upper and lower electromagnet coils connected in series illustrating armature position and velocity as a function of time for a representative exhaust valve opening event. Line 180 represents armature position with the origin corresponding to the midpoint between the upper and lower electromagnets. The initial or starting position of −4 mm corresponds to the valve closed position with the armature being held against the upper electromagnet as indicated at 182. Line 184 represents armature velocity, which begins at zero as represented generally at 186. To initiate the valve opening event, a launching pulse of about −0.2 volt*seconds (Vs) is provided to lower the magnetic energy of the upper coil so that the associated spring begins to move the armature away from the upper electromagnet. The launching pulse may be applied by controlling the power supply and/or one or more switching elements to provide a first voltage polarity of −200 volts (V) for about one millisecond (msec), for example. As the armature moves away from the upper electromagnet, the velocity increases to a maximum of about 2 m/sec before reaching the midpoint at a position of about −2 mm as indicated at 188 and 190, respectively. Velocity then decreases as the armature proceeds through the midpoint toward the lower electromagnet until a catching pulse having a second voltage polarity is applied at a time of about 8.5 milliseconds (msec) as indicated at 192. The illustrated representative catching pulse corresponds to controlling the power supply and/or switching device(s) to provide a second polarity pulse of +200 volt (V) across the series connected coils at a time of about 8.5 milliseconds (msec). The velocity goes to zero as the armature is held against the lower electromagnet at a position of +4 mm as indicated at 194.

The armature reaches a maximum velocity before crossing the midpoint because the upper coil is generating damping force and transferring its energy to the lower coil. As illustrated, a very soft landing is possible in this case (unoptimized) based on the low velocity of the armature when it reaches the catching region or zone of the lower electromagnet. The control system parameters may be adjusted to optimize the armature velocity and timing of the event based on the feed forward energy injected by the power supply into the coils during the event. In the example illustrated in FIG. 5, the feed forward energy injected makes up for the gas work, friction, and the original energy removed by the launching pulse. Alternatively, the actuator with series connected coils could be controlled to completely remove the energy from the launching coil during launch and transferring it to the catching coil during a shorter period near the end of the event.

Figure 6:
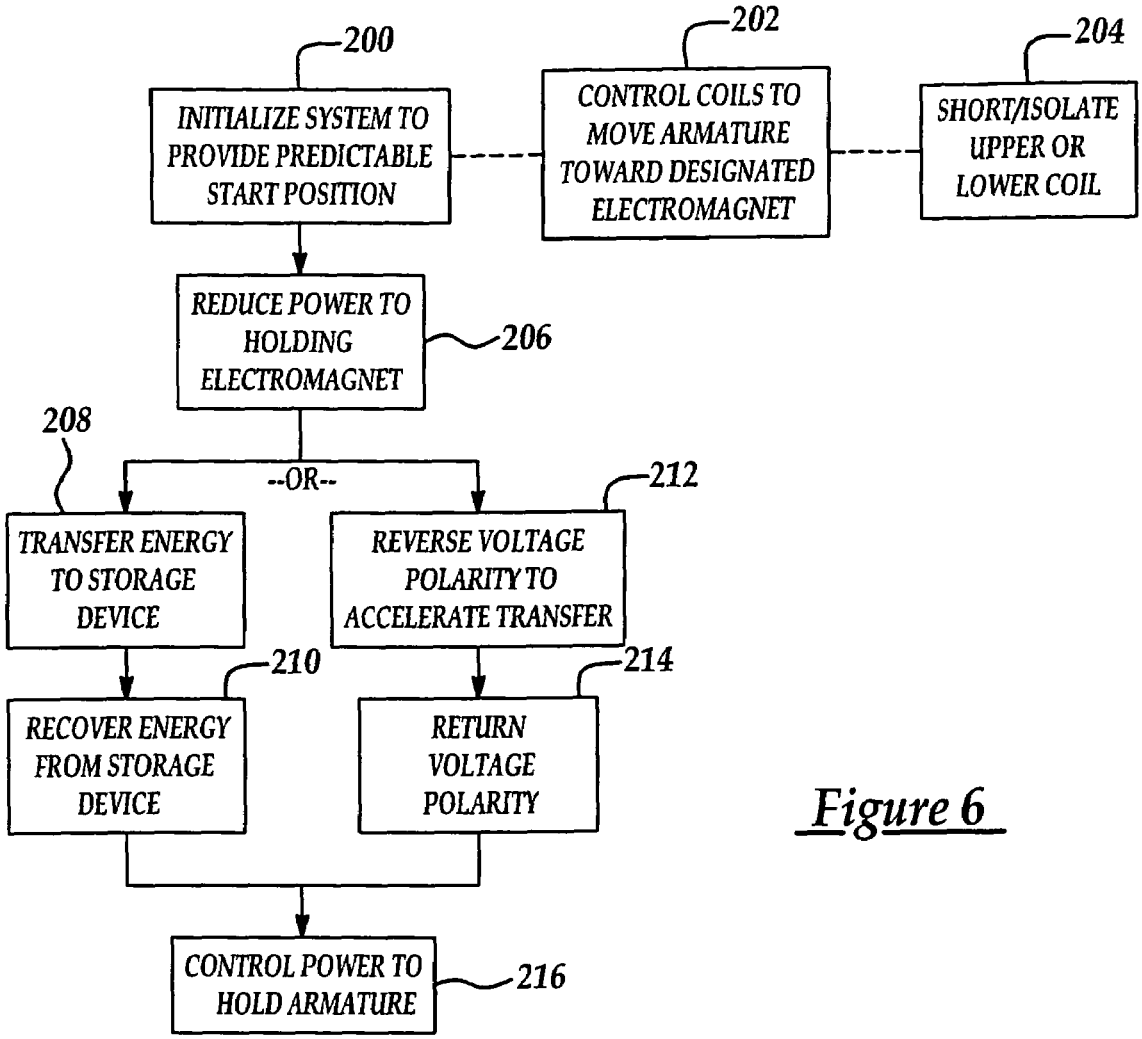
FIG. 6 is a flow chart illustrating operation of a system or method for valve actuation with start-up control according to one embodiment of the present invention.

FIG. 6 is a flow chart illustrating operation of a system or method for valve actuation with series connected coils according to one embodiment of the present invention. The diagram of FIG. 6 generally represents control logic for one embodiment of a system or method according to the present invention. As will be appreciated by one of ordinary skill in the art, the diagram may represent any one or more of a number of known processing strategies such as event-driven, interrupt-driven, multi-tasking, multi-threading, and the like. As such, various steps or functions illustrated may be performed in the sequence illustrated, in a modified sequence, in parallel, or in some cases omitted. Likewise, the order of operation or processing is not necessarily required to achieve the objects, features, and advantages of the invention, but is provided for ease of illustration and description. Although not explicitly illustrated, one of ordinary skill in the art will recognize that one or more of the illustrated steps or functions may be repeatedly performed depending upon the particular application and processing strategy being used. Preferably, the control logic is implemented primarily in software executed by a microprocessor-based engine controller. Of course, the control logic may be implemented in software, hardware, or a combination of software and hardware depending upon the particular application. When implemented in software, the control logic is preferably provided in a computer-readable storage medium having stored data representing instructions executed by a computer to control one or more components of an internal combustion engine. The computer-readable storage medium or media may be any of a number of known physical devices which utilize electric, magnetic, and/or optical devices to temporarily or persistently store executable instructions and associated calibration information, operating variables, and the like.

As represented by block 200, the system is initialized after power-up to provide a predictable starting position for the valve, either open or closed. Depending upon the particular application and implementation, the initial starting position may be predetermined for a particular valve, or may be determined at each start up depending upon current operational and/or ambient conditions. The starting control may vary depending upon the particular implementation of the start-up or initialization device associated with the actuator. For example, an actuator may include one electromagnet that generates a greater attractive force than the opposing electromagnet for a given current passing through the series-connected coils of the electromagnets. For this implementation, the coils may be controlled to move the armature toward a designated electromagnet (with the greater number of windings) as represented by block 202 by inducing a current through both coils. Alternatively, a switching device may be controlled to short or isolate the upper or lower coil as represented by block 204 and illustrated and described with reference to FIGS. 2 and 3. Other alternative initialization configurations may be used alone or in combination with the above. For example, one electromagnet may incorporate a permanent magnet or a modified core geometry or material to provide a bias toward a selected electromagnet for a given current passing through both electromagnets.

Preferably, the start-up or initialization device may be selectively applied during initialization to provide a predictable armature/valve position with the armature being held against one of the electromagnets and subsequently deactivated so that it has minimal or no effect on subsequent valve actuation.

After initialization, valve actuation may be initiated by reducing the attractive force of the holding electromagnet. As represented by block 206, the attractive force of the holding electromagnet may be reduced by reducing the power supplied to the holding electromagnet coil. Various other methods may also be used alone or in combination with lowering the power to reduce the attractive force of the holding electromagnet so that the associated spring force begins to move the armature away from the electromagnet. As the armature moves away from the original holding electromagnet, energy may be transferred to the opposing or catching electromagnet either indirectly as illustrated by blocks 208 and 210 or directly as illustrated by blocks 212 and 214.

One or more switching devices may be controlled to selectively transfer energy stored in the series connected coils to an energy storage device as represented by block 208 as the armature traverses the gap between the opposing electromagnets. When the armature approaches a catching zone of the catching electromagnet, the switching device(s) are controlled to transfer the stored energy back to the coils as represented by block 210. The power supplied to the catching electromagnet may then be controlled to provide an appropriate holding force to hold the armature as represented by block 216.

For applications that transfer stored energy directly between series connected electromagnets, the voltage polarity across the electromagnets may be reversed while maintaining current direction to generate an attractive force as represented by block 212. Reversing voltage polarity may reduce the time necessary to transfer stored energy between the electromagnets. After the armature is caught and the valve landed, the original voltage polarity is returned as represented by block 214. The power supplied to the holding electromagnet may then be controlled to provide a holding current that generates a sufficient attractive force in the holding electromagnet to hold the armature against the opposing spring force.

While the best mode for carrying out the invention has been described in detail, those familiar with the art to which this invention relates will recognize various alternative designs and embodiments for practicing the invention as defined by the following claims.

What is claimed:

1. A method for controlling an internal combustion engine having a plurality of cylinders each having at least one intake and exhaust valve with at least one of the valves being operated by an electromagnetic actuator having an armature coupled to the valve and traveling between first and second electromagnets to open and close the valve in response to a control signal from an actuator control, the first electromagnet having a first coil connected in series to a second coil of the second electromagnet, the method comprising:

reducing attractive force generated by the first and second electromagnets to allow a spring associated with the first electromagnet to begin moving the actuator away from the first electromagnet, movement of the actuator generating an internal voltage difference between the first and second coils to induce a current increase through the first and second coils and transfer stored energy from the first electromagnet to the second electromagnet to increase attractive force of the second electromagnet to catch the armature without reversing current flow direction through the first and second coils.

2. The method of claim 1 wherein the step of reducing attractive force generated by the first and second electromagnets comprises controlling a power supply to reduce power supplied to the first and second coils.

3. The method of claim 2 wherein controlling the power supply comprises controlling current supplied to the first and second coils.

4. The method of claim 2 wherein controlling the power supply comprises controlling voltage across the first and second coils.

5. The method of claim 1 further comprising:

reversing voltage polarity across the first and second coils to reduce energy transfer time from the first electromagnet to the second electromagnet while maintaining current flow direction through the first and second coils to generate an attractive force in the second electromagnet.

6. The method of claim 1 wherein energy is transferred directly from the first electromagnet to the second electromagnet.

7. The method of claim 1 wherein energy is transferred indirectly from the first electromagnet to the second electromagnet.

8. The method of claim 7 wherein energy is transferred from the first electromagnet to an energy storage device as the armature moves toward a midpoint between the first and second electromagnets and from the energy storage device to the second electromagnet as the armature moves away from the midpoint.

9. The method of claim 7 further comprising:

controlling at least one switching device to selectively couple the first and second coils to an energy storage device to transfer energy from the first and second coils to the energy storage device as the armature moves toward a midpoint between the first and second electromagnets; and controlling at least one switching device to selectively couple the energy storage device to the first and second coils to transfer energy from the energy storage device to the first and second coils as the armature moves away from the midpoint.

10. The method of claim 1 further comprising:

generating an attractive force in the first electromagnet greater than an attractive force of the second electromagnet to provide a predictable starting position.

11. The method of claim 10 wherein the step of generating comprises reducing or eliminating current flow through the second coil.

12. The method of claim 10 wherein the step of generating comprises controlling at least one switching device to selectively short the second coil.

13. The method of claim 10 wherein the first electromagnet has a higher effective relative magnetic permeability than the second electromagnet.

14. The method of claim 10 wherein the first coil has a greater number of windings than the second coil.

15. A method for actuating an intake or exhaust valve of an internal combustion engine using an electromagnetic valve actuator having an armature connected to the valve and traveling across a gap between first and second electromagnets having corresponding first and second coils connected in series to open and close the valve, the method comprising:

generating a greater attractive force in the first electromagnet relative to the second electromagnet to provide a predictable starting position for the armature;

reducing attractive force of the first coil so associated spring force begins to move the armature away from the first electromagnet;

coupling an energy storage device to the first and second series connected coils to transfer energy from the first electromagnet to the energy storage device as the armature moves toward a midpoint between the first and second electromagnets; and coupling the first and second coils to the energy storage device to transfer energy from the energy storage device to the second electromagnet as the armature moves away from the midpoint.

16. The method of claim 15 further comprising:

controlling a power supply to generate an attractive force in the second electromagnet to hold the armature against an associated spring force.

17. The method of claim 15 wherein the step of generating comprises controlling at least one switching device so that current through the first coil exceeds current through the second coil.

18. The method of claim 15 further comprising controlling at least one switching device to selectively reverse voltage polarity across the first and second coils to facilitate energy transfer from the first electromagnet to the second electromagnet.

19. A system for actuating an intake or exhaust valve of an internal combustion engine, the system comprising:

an electromagnetic actuator having an armature connected to the valve and traveling across a gap between first and second electromagnets having corresponding first and second coils connected in series to open and close the valve; and a device for selectively generating an attractive force in the first electromagnet greater than the attractive force in the second electromagnet to provide a predictable starting position for the armature.

20. The system of claim 19 wherein the device comprises at least one switching device for selectively reducing current passing through the second electromagnet relative to current passing through the first electromagnet.

21. The system of claim 19 wherein the device comprises a permanent magnet oriented to increase the attractive force of the first electromagnet relative to the second electromagnet.

22. The system of claim 19 wherein the device comprises a transistor connected across the second coil to selectively isolate the second coil.

23. The system of claim 19 further comprising an energy storage device selectively coupled to the first and second coils by at least one switching device.

* * * * *